US007384380B2

(12) United States Patent
Reinbold et al.

(10) Patent No.: US 7,384,380 B2
(45) Date of Patent: Jun. 10, 2008

(54) METHOD AND SYSTEM FOR DETECTING AND DISPLAYING THE IMPACT OF A BLOW

(75) Inventors: Kirk A. Reinbold, Chester Springs, PA (US); Robert J. Goldman, Philadelphia, PA (US); Barry Lyngard, Flourtown, PA (US); Silvio Eberhardt, Pownal, VT (US); Peter Michel, King of Prussia, PA (US); Albert Augustine, Jr., Narberth, PA (US)

(73) Assignee: Sensorpad Systems Inc., Norristown, PA (US)

( * ) Notice: Subject to any disclaimer, the term of this patent is extended or adjusted under 35 U.S.C. 154(b) by 25 days.

(21) Appl. No.: 11/180,420

(22) Filed: Jul. 13, 2005

(65) Prior Publication Data

US 2005/0250625 A1 Nov. 10, 2005

Related U.S. Application Data

(63) Continuation of application No. 10/350,581, filed on Jan. 24, 2003, now Pat. No. 6,925,851.

(60) Provisional application No. 60/351,626, filed on Jan. 24, 2002.

(51) Int. Cl.
*A63B 21/00* (2006.01)

(52) U.S. Cl. ..... 482/91; 482/8; 73/12.09

(58) Field of Classification Search ..... 73/862, 73/581, 12.09; 600/595; 482/83–90
See application file for complete search history.

(56) References Cited

U.S. PATENT DOCUMENTS 2,767,920 A 10/1956 Roberson
4,763,284 A 8/1988 Carlin
4,823,619 A 4/1989 D'Antonio et al.

(Continued)

FOREIGN PATENT DOCUMENTS

WO WO 9854581 12/1998

OTHER PUBLICATIONS

Examination Report dated Dec. 21, 2004 for Great Britain Patent Application No. GB0418850.4.

*Primary Examiner*—Jerome W. Donnelly
(74) *Attorney, Agent, or Firm*—Duane Morris LLP

(57) ABSTRACT

A system for detecting and displaying force data relating to impacts received on an item of athletic equipment includes two or more items of athletic equipment each having a force sensor, logic and a wireless transmitter therein, a receiver adapted to receiver signals from each of the transmitters, and a processor for formatting the data for display. The force sensor may be a capacitive force sensor. The logic may have an operating mode and a sleep mode, with an inertial sensor providing a signal to cause the logic to switch from sleep mode to operating mode. The logic identifies and stores signals exceeding a threshold for transmission. Transmissions are repeated, and the receiver is adapted to distinguish and discard corrupted and repeated transmissions. The display provides an indication of force and number of recorded hits in association with the names of the competitors. The athletic equipment may be boxing gloves, and the force and number of hit data may be provided simultaneously with images and commentary for a boxing match. The data may be displayed as a standalone graphic or superimposed over an image of a match.

20 Claims, 11 Drawing Sheets

U.S. PATENT DOCUMENTS

| | | | |
|---|---|---|---|
| 4,824,107 | A | 4/1989 | French |
| 4,941,660 | A | 7/1990 | Winn et al. |
| 4,987,783 | A | 1/1991 | D'Antonio et al. |
| 5,184,831 | A | 2/1993 | Garner |
| 5,279,163 | A | 1/1994 | D'Antonio et al. |
| 5,449,002 | A | 9/1995 | Goldman |
| 5,471,405 | A | 11/1995 | Marsh |
| 5,553,860 | A | 9/1996 | Zelikovich |
| 5,605,336 | A | 2/1997 | Gaoiran et al. |
| 5,662,123 | A | 9/1997 | Goldman |
| 5,723,786 | A | 3/1998 | Klapman |
| 5,741,970 | A | 4/1998 | Rubin |
| 5,775,332 | A | 7/1998 | Goldman |
| 6,033,370 | A | 3/2000 | Reinbold et al. |
| 6,056,674 | A | 5/2000 | Cook |
| 6,126,572 | A | 10/2000 | Smith |
| 6,183,365 | B1 | 2/2001 | Tonomura et al. |
| 6,595,901 | B2 | 7/2003 | Reinbold et al. |
| 6,611,782 | B1 | 8/2003 | Wooster et al. |
| 6,616,579 | B1 | 9/2003 | Reinbold et al. |
| 2002/0037759 | A1 | 3/2002 | Aldridge |
| 2003/0054905 | A1 | 3/2003 | King, Jr. |

505 510 525 515 518 520

Round 1
Channel 4 : Temperature : 88
Channel 3 : 1 Maximum Force: 31 Samples Before: 26 Samples After: 56
Channel 3 : 2 Maximum Force: 4 Samples Before: 5 Samples After: 31
Channel 2 : 1 Maximum Force: 4 Samples Before: 4 Samples After: 31
Channel 2 : 2 Maximum Force: 7 Samples Before: 6 Samples After: 36
Channel 2 : Temperature : 89
Channel 4 : 1 Maximum Force: 6 Samples Before: 7 Samples After: 38
Channel 3 : 3 Maximum Force: 20 Samples Before: 20 Samples After: 46
Channel 3 : 4 Maximum Force: 4 Samples Before: 11 Samples After: 31
Channel 3 : Temperature : 88
Channel 4 : 2 Maximum Force: 13 Samples Before: 13 Samples After: 44
Channel 1 : Temperature : 89
Channel 3 : 5 Maximum Force: 4 Samples Before: 6 Samples After: 31
Channel 1 : 1 Maximum Force: 5 Samples Before: 18 Samples After: 37

FIG. 11

METHOD AND SYSTEM FOR DETECTING AND DISPLAYING THE IMPACT OF A BLOW

RELATED APPLICATIONS

This application is a continuation of U.S. application Ser. No. 10/350,581, filed on Jan. 24, 2003, now U.S. Pat. No. 6,925,851, which claims priority from U.S. Provisional Patent Application No. 60/351,626, filed Jan. 24, 2002, which applications are hereby incorporated by reference herein in its entirety.

FIELD OF THE INVENTION

This invention relates to sports equipment, particularly boxing equipment and equipment for use in martial arts, and to broadcasts of sporting events, particularly boxing matches.

BACKGROUND OF THE INVENTION

The determination of the force of a blow is of interest in a variety of athletic competitions and training contexts. For example, in professional boxing matches there are four criteria used for scoring: effective aggressiveness, command of the ring, defense and number of blows landed. With specific reference to number of blows landed, three factors render it difficult for judges to accurately and consistently perform this task: 1) The speed of the matches makes it relatively easy to miscount the number of blows; 2) A judge may not be able to see some of the action clearly because of obstruction by the bodies of the boxers or the referee; 3) Even when blows are clearly seen, it is difficult to judge from the angle and distance of the judges whether the blow is of sufficient impact to be scored. As a result, the scoring by different judges, as well as by the press and other observers can disagree, resulting in controversy over the outcome of a match.

In addition to scoring a match, determining the number and force of blows are important for training for a match, to indicate readiness of fighters for competitive matches, and to best match fighters with similar abilities.

The appeal of boxing as entertainment has waned in recent years, and the audience for boxing continues to age. Younger television audiences for other sports have come to expect visual measures and cues to enhance the viewing experience. Boxing lacks such visual measures. The televised presentation of force and number of blows in a visually arresting way would enhance viewer interest and enthusiasm, thus enhance ratings and revenue from boxing as entertainment.

It will be appreciated that measurement of the number and force of blows would be desirable in training and matches in various martial arts. Measurement and display of the force and other characteristics of impacts are also desirable in other sports, particularly contact sports such as football.

One approach to this problem is explored by U.S. Pat. No. 5,723,786 (Klapman), which provides an accelerometer in a boxing glove, and thus can only measure the acceleration/deceleration of blows. Although of some value, acceleration cannot be translated into force, a much more understandable means of describing the blow, because the mass of the projectile (e.g., head, body, arm) cannot be accurately determined.

Another approach in the prior art to attempting to display the force of a blow during boxing matches is disclosed by U.S. Pat. No. 4,763,284 (Carlin), which uses data from pressure transducers on the wrist bones of boxers as a surrogate for the force of a blow. Signals representing vibrations detected by the pressure transducers are provided by wire from the detector to a transmitter unit worn on the athlete's body. Carlin does not measure force directly, and the addition of such equipment is not likely to be acceptable to boxers, and indeed may represent a safety risk to the boxers.

SUMMARY OF THE INVENTION

In one aspect of the invention, an article of athletic equipment is adapted to detect a characteristic of an impact and provide an output signal representative of the detected characteristic. Detected characteristics include peak force, duration, energy, and other information. The article includes a conventional item of athletic equipment with a body having an outer surface portion, a force detector located within the body, a circuit coupled to the detector and adapted to provide an output signal representative of a force detected by the force detector, and a transmitter located in the body for receiving the output signal from the circuit and transmitting a wireless signal representative of said signal. The transmitter may be a radio frequency transmitter, and the receiver a radio frequency receiver.

In another aspect of the invention, a system for detecting and displaying a characteristic of impacts on first and second articles of athletic equipment, includes first and second force sensors located respectively within first and second articles of athletic equipment, said sensors each having an output coupled to a wireless transmitter located within the respective article of athletic equipment, a receiver for receiving signals from said transmitters, said signals containing sensor data and article of athletic equipment identifying data, and a processor for processing signals received by the receiver and providing a display signal.

A method for processing signals representing force detected on an article of athletic equipment comprises the steps of sampling force data, storing sampled force data in excess of a threshold, comparing said stored sampled force data with sampled data received within a time interval, selecting a higher of said stored and said received sampled data, and selectively transmitting signals representing the highest sampled data received within said time interval, said steps of comparing and transmitting being carried out within said article of athletic equipment. The number of received highest sampled data represents incidents, which may be counted over a selected time period. For example, the incidents may be hits on a sensor in a boxing glove, and the time period may be one round in a boxing match.

A method for display of data representing forces of impacts on articles of athletic equipment includes receiving data representing forces of impacts on an article of athletic equipment, wherein the data is derived from a signal provided by a force sensor located within the article of athletic equipment to a wireless transmitter located within the article of athletic equipment, the data having been wirelessly transmitted by the wireless transmitter and received at a receiver prior to said step of receiving, and displaying the data.

A method for enhancing the viewing of a boxing match to an audience includes the step of generating, in each glove of each boxer, a signal indicating the impact of a blow landed by the boxer, communicating the signal to a remote receiver, and displaying an impact force value to the audience during the match. The step of displaying an impact force value to the audience may include incorporating an impact force value in a display provided by a television transmission of the match. The step of displaying an impact force value may also include the step of displaying the value at a resource accessible over a network, such as on a page on a World Wide Web server.

A method for assisting in the scoring of a boxing match includes the steps of generating, in each glove of a boxer, a signal having a value indicating the impact of a blow landed by the boxer, comparing the generated signal value to a threshold impact value, and indicating to the judges in real-time when a blow exceeds the threshold impact force value. The method may further include displaying the awarded points obtained to a local or remote audience during the match.

These methods and systems overcome the disadvantages of the prior art. The sensor and transmitter units of the invention are light in weight and employ thin, conformable sensors that do not appreciably alter the feel and weight of the items of athletic equipment. The display of a recorded number of hits and data relating to a characteristic of a blow together with images of a bout is highly desirable to viewers.

BRIEF DESCRIPTION OF THE FIGURES

FIG. 11 is an example of a text display in accordance with the invention.

DETAILED DESCRIPTION

Figure 1:
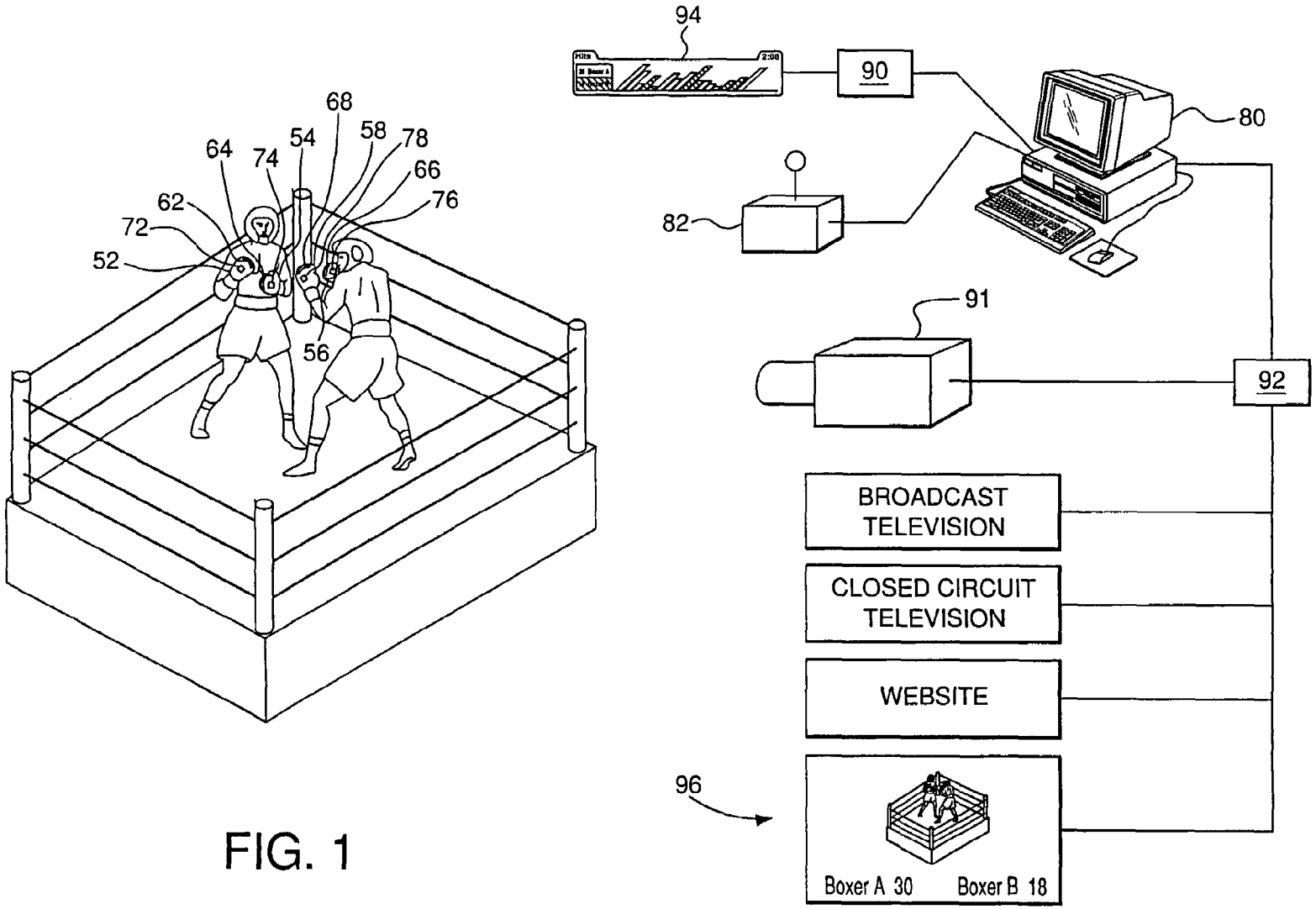
FIG. 1 is an overview of a system according to the invention.

The system of the invention includes components in an article of athletic equipment, including a sensor, a circuit and a transmitter, and components external, including a receiver, data processor, and various display technology. The method of the invention includes processes carried out within an article of athletic equipments, as well as processes carried out in connection with the transmission, analysis, storage and display of data representing forces and numbers of hits detected on an article of athletic equipment. FIG. 1 is a schematic overview of a system of the invention for use in multiple items of athletic equipment, specifically in the context of a boxing match. A boxing match is shown. The two boxers each have a pair of boxing gloves; these are boxing gloves 52, 54, of a first boxer, and boxing gloves 56, 58 of a second boxer. Each boxing glove has therein a force sensor positioned in a portion of glove selected to receive a blow. Each boxing glove has one of sending units 72, 74, 76, 78, as described below, which receives signals from force sensors 62, 64, 66, 68, determines if those signals are suitable for transmission, and selectively transmits those signals. Signals from all of transmitters 72, 74, 76, 78 are received by receiver 82. Each transmitter may employ a signal distinguished from the signals emitted by the other transmitters. Receiver 82 distinguishes corrupt and repeated data signals. Receiver 82 furnishes signals to processor 80. Processor 80 may be a general-purpose computer running suitable software and with memory to provide the functions described below. It will be understood that the performance of the method is not limited to the use of a single processor. Suitable input devices and protocols, such as serial input/output connections associated with RS-232 and RS-422 protocols, may be used to connect processor 80 to receiver 82.

The processor 80 receives signals from receiver 82. In particular, signals from receiver 82 represent the force of blows detected by force sensors 62, 64, 66, 68. The signals also identify the article of athletic equipment in which the force sensor was located. When processor 80 receives a signal indicative of a blow detected by one of sensors 62, 64, a number of steps may be taken. A memory location storing a number of blows detected for the first boxer has the number incremented by one. A numerical value associated with the blow may be formatted for display on the computer screen. When processor 80 identifies a blow detected by one of sensors 66, 68, similarly, a memory location storing a number of blows detected for the second boxer has the number incremented by one. A numerical value associated with the blow may be formatted for display on the computer screen. Such information as boxer names may also be displayed, along with any other information obtained from other sensors in the gloves.

The data provided by the processor, such as the number of blows, the force of the blows, and the like, may be output from the processor. The data may be transmitted to audio/video display controller 92, which may add the data to a live video display. The video display may include the names of the boxers, the time of the round, the number of detected blows in the match and in the round, and the force of recent blows. The timing of appearance of information representing the force of blows may be synchronized with the video signal, so that a representation of the force of a blow appears simultaneously with the blow itself. The video display may be transmitted live or delayed over an air broadcast, cable, satellite, Pay Per View, Internet, closed circuit or other audio/visual transmission.

The data may also or alternatively be provided to arena display controller 90. In this embodiment, arena display controller 90 transmits the data periodically to one or more arena displays 94. Exemplary arena display 94 contains the names of the boxers and numbers of blows recorded by the system associated with each boxer. Camera 91 provides a video signal to audio/video display controller 92. Audio/video display controller 92 adds a graphic to the video signal, which graphic includes the names of the boxers and the number of recorded blows, and which may be recorded in a selected portion of the video image, as indicated in an exemplary fashion by video display 96.

Figure 2:
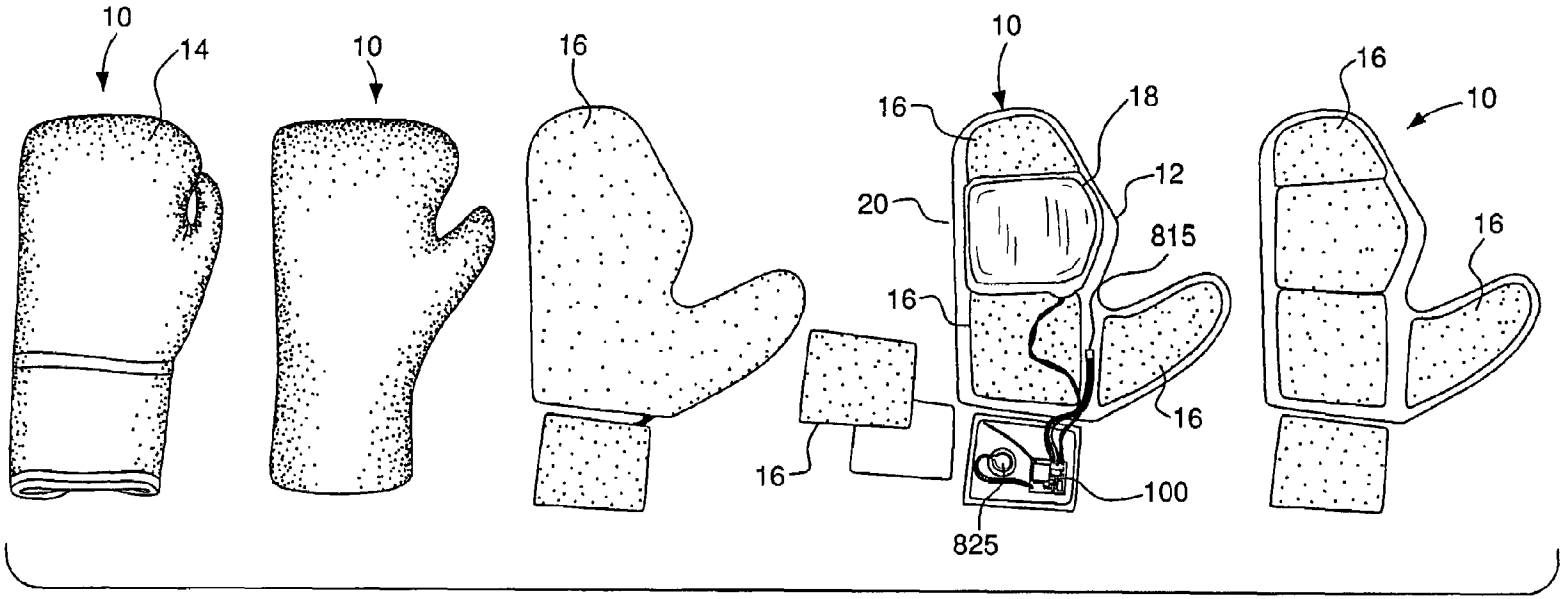
FIG. 2 provides views of a partially-assembled article according to the invention.

FIG. 2 is an illustration of an article of athletic equipment in accordance with the invention. In particular, a modified boxing glove 10 having various components of the invention is shown. The modified boxing glove 10 is shown in various stages. As is conventional, boxing glove 10 has an inner lining 12, an outer shell 14, and intermediate padding 16. In the boxing glove of the invention, a force sensor 18 is provided. The force sensor may be a capacitive force sensor of any of the types shown and described in U.S. Pat. No. 6,033,370, which is incorporated by reference herein. Without limiting the foregoing, force sensor 18 is preferably a two or three plate capacitor, having an open-cell polyurethane foam dielectric and flexible conductive mesh for conductors. Particularly for a two-plate capacitor, shielding with respect to external sources of electromagnetic radiation may be provided. A three-plate capacitor provides shielding for internal components. The sensor dielectric is not limited to polyurethane foam and other compressible polymers such as closed-cell neoprene or silastic rubber could be used. The particular material employed may be selected based on the response to various ranges of force or other detected characteristics. This invention is further not limited to the force sensor used and alternatives could include air, liquid or gel filled pressure sensors, piezoelectric, piezoresistive or capacitive films or strain gauges.

The sensor desirably has a number of properties. These properties include being light in weight, so that the total weight of the sensor and related electronics is less than about one ounce. A further property is that the sensor is conformable to the surrounding padding and other materials making up the glove. Further, the sensor should be rugged, in being able to receive thousands of blows of hundreds of pounds, with only a few percent change in response. Sensors are preferably flexible and soft, so that they are not detected by the boxer and do not change the feel of the glove.

Figure 3:
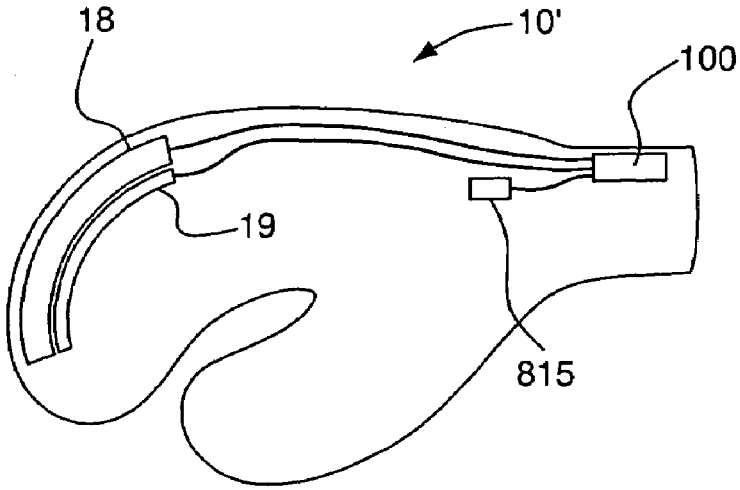
FIG. 3 is a schematic sectional view of an alternative article according to the invention.

Force sensor 18 is preferably positioned in the portion 20 of the glove 10 that is adjacent the fingers and knuckles of the boxer when worn. As shown in FIG. 3, in an alternative glove 10', second sensor 19 may also be included. Second sensor 19 may be identical to force sensor 18 and employed to provide redundancy in the event of damage to force sensor 19. Second sensor 19 may also be a capacitive sensor but employ a different dielectric to provide different response characteristics. For example, the dielectric of second sensor 19 may be more or less stiff than the dielectric of sensor 18. Such a second sensor may provide better response at either greater or lesser force levels. A software switch may be provided to selectively use data from one or more different sensors depending on the detected force levels. Second sensor 19 may be of a different type, such as a piezoelectric or piezoresistive sensor, which may be employed either for redundancy or to provide different force characteristics. As a further alternative, a desired number of sensors may be arranged in a single level to obtain additional information as to impact location.

Figure 4:
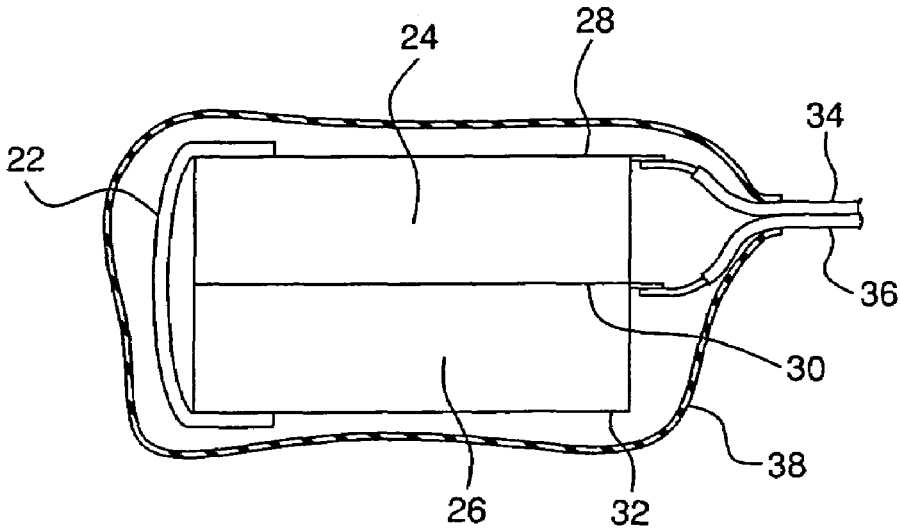
FIG. 4 is a sectional view of a sensor in accordance with the invention.

FIG. 4 is a sectional view of force sensor 18 and related hardware. The height of sensor 18 is exaggerated for clarity. Sensor 18 has dielectric layers 24, 26, and conductive layers 28, 30, 32. Conductive layers 28, 30, 32 may be a fine wire mesh, for example. Wire 36 is in electrical contact with central conductor 30 and wire 34 is in electrical contact with at least one of end conductors. Conductors 28 and 32 are electrically connected or shorted together such as by a conductive tape 22. Conductive layers 28, 30, 32 may extend at least in one portion of the sensor 18 beyond dielectric layers 24, 26, and wires 34, 36 may be crimped, soldered or otherwise connected to the extended portion of the conductive layers. Insulating material, such as an insulating adhesive, or a silicone based compound, may be applied to the sides of the sensor to prevent possible shorting from fraying of the edges of the layers. A flexible water-impermeable sheet 38 provides a sealed container which prevents moisture from contacting sensor 18. Sheet 38 may be made of any suitable water-impermeable sheet material. Plastic sheet materials such as polyethylene and polypropylene may be employed, for example. Sheet 38 may be made from two separate pieces of sheet material which are sealed by heat sealing or gluing around its perimeter. Various adhesives, such as hot glue or epoxy may be employed to provide a seal between sheet 38 and the insulation of wires 34, 36.

Figure 5:
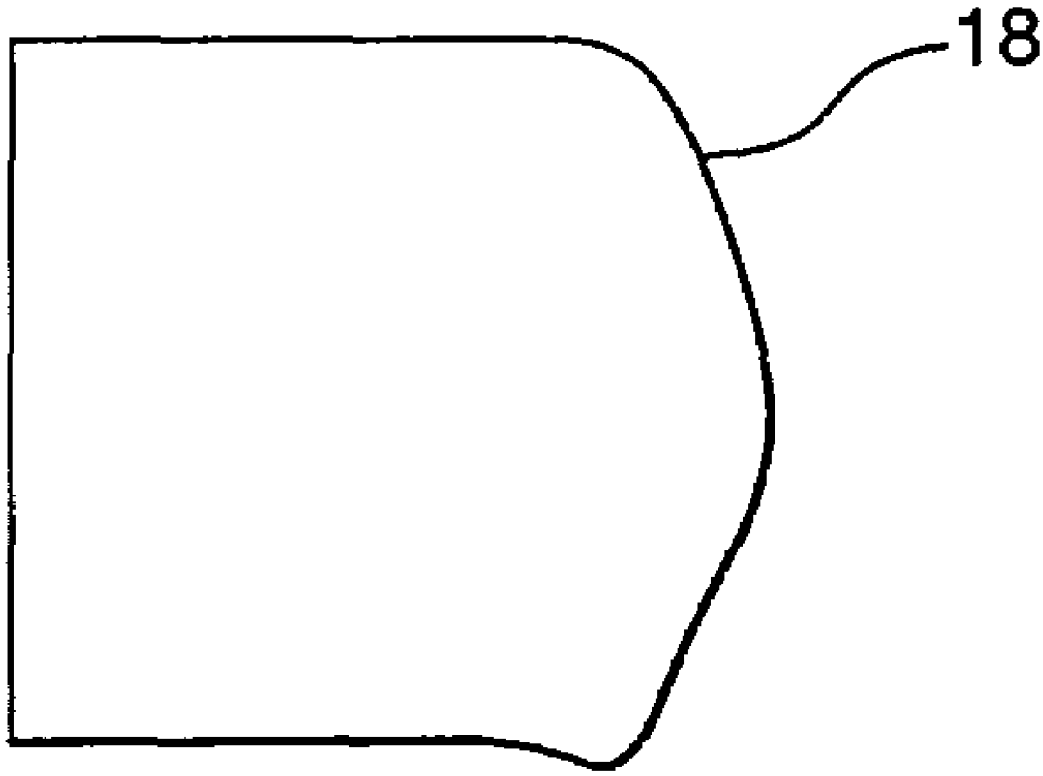
FIG. 5 is a plan view of a sensor in accordance with the invention.

FIG. 5 is a top plan view of an embodiment of force sensor 18. The force sensor may have a generally rectangular shape, with dimensions from about 3.5 inches to about 5 inches on each side. The sensor may have the shape depicted in FIG. 5, which features a generally rectangular shape, having curved corners. A side located nearest the cuff of the boxing glove is preferably angled toward the cuff at one side. A side preferably has a convex generally curving shape, as depicted. The length and width of the sensor may be varied for use in boxing gloves of differing size and design. One of ordinary skill in the art will appreciate that the sensor will cover the portions of the glove that may be used for a scoring blow. The particular portions that may be used for a scoring blow will vary depending, for example, on whether the glove is intended for amateur or professional use. The particular size of the sensor may be varied for boxing gloves of various sizes. One or more additional sensors may be positioned in the glove in non-overlapping relation to sensor 18. These sensors may detect impacts that are not counted in scoring. For example, additional sensors may be placed over the ends of fingers to detect non-scoring impacts such as sharp pokes with the fingers.

The length and width of the sensor may be substantially altered for use in athletic equipment other than boxing gloves. For example, if the sensor of the invention is used on footwear in martial arts that permit blows with the foot, the shape of the sensor will be dictated by the legal scoring portions of the foot. If the sensor of the invention is used in training equipment, such as punching bags, the shape and size of the sensor will be dictated by the area that blows are to be landed for training purposes.

A sensor driving circuit 100 is provided for generating a signal representative of the force imparted to the sensor. Such circuits are shown, for example, in U.S. Pat. No. 6,033,370. Other circuits which can detect the variation in capacitance with force may be designed by those skilled in the art. The circuit hardware 100 is preferably located in glove 10 itself, in a portion remote from portion 20, as indicated in FIG. 2. A resistor is preferably used to charge the sensor toward a battery supply 825. Replaceable or rechargeable batteries may be employed. A miniature jack or a magnetic pickup coil may be provided for recharging batteries. Temperature sensor 815 is also provided in glove 10, as is antenna 835.

In summary, the circuit detects a value, or sample, related to the capacitance of the sensor, subtracts a baseline from that value, and compares that value to a threshold. In the illustrated embodiment, the sensor is discharged, and then charged toward the battery supply across a resistor. The time elapsed from sensor discharge to when the sensor voltage reaches a specified value is measured. The specified value may be a value sufficient to create a logical high on a microprocessor input. If the value is greater than the threshold, then the value is compared to the maximum value for the current hit. Samples are taken frequently, such as at a rate between about 1,800 and about 10,000 samples per second. The current hit includes all of the above-threshold samples, usually occurring within a brief time window, such as about 15 milliseconds to about 25 milliseconds. If the detected value exceeds the maximum for the current hit, then the maximum is updated using the detected value. This process continues until a maximum value is determined for the current hit. It has been observed by the inventors that a single hit may have more than one peak. Accordingly, it is not possible to conclude that the peak has been reached when the current value is less than the maximum for the current hit. To ensure that a hit has been completed, a specified number of successive below-threshold samples must be recorded. Once the maximum value is determined, a wireless signal representative of the maximum value is transmitted. Other data relating to the hit, such as the time associated with the hit, and the duration of the hit, may be transmitted as well. The transmission of this single value associated with each hit minimizes the amount of transmission time required, and thereby extends battery life. As there is a need to maintain the apparatus within the boxing glove without significant effect on the weight of the boxing glove, batteries are necessarily small, and extension of battery life is important to the success of the device of the invention. However, in principle, values obtained at other times may be transmitted as well.

A baseline value for the capacitance, or its surrogate, may be fixed. Alternatively, the device of the invention determines a baseline value for the capacitance, or its surrogate. This baseline is periodically updated, as the baseline may otherwise drift as a result of a variety of factors.

The device of the invention provides a temperature reading, as it has been found that in some cases temperature may vary the detected values. Suitable calibration can be carried out at various temperatures, and an algorithm created to accommodate for variations in temperature readings. Detected temperature data may be transmitted from time to time.

As a further means of extending battery life, the electronics has a sleep mode in which little or no processing takes place. If no values above the threshold are detected for a selected period of time, the device enters a sleep mode. Very little current is drawn during sleep mode. A preferred means for causing the device to terminate sleep mode and return to its standard mode is an inertial switch. However, other types of devices may be employed. For example, operator input could be detected from a physical switch or other mechanical input, or a wireless signal receiver may be incorporated in the device of the invention.

Figure 6:
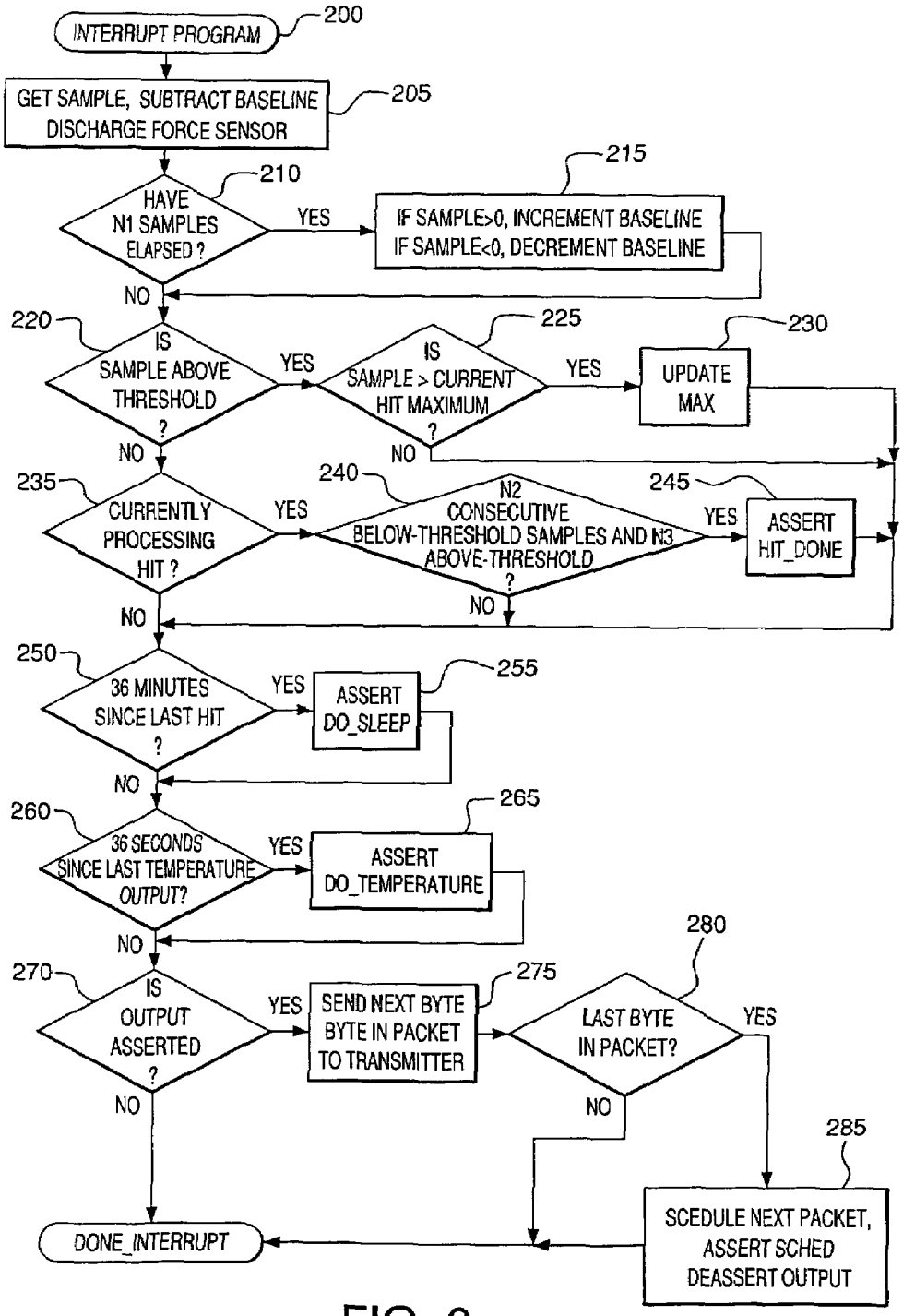
FIG. 6 is a flow chart illustrating a high level process flow in a sending unit according to the invention.
Figure 7:
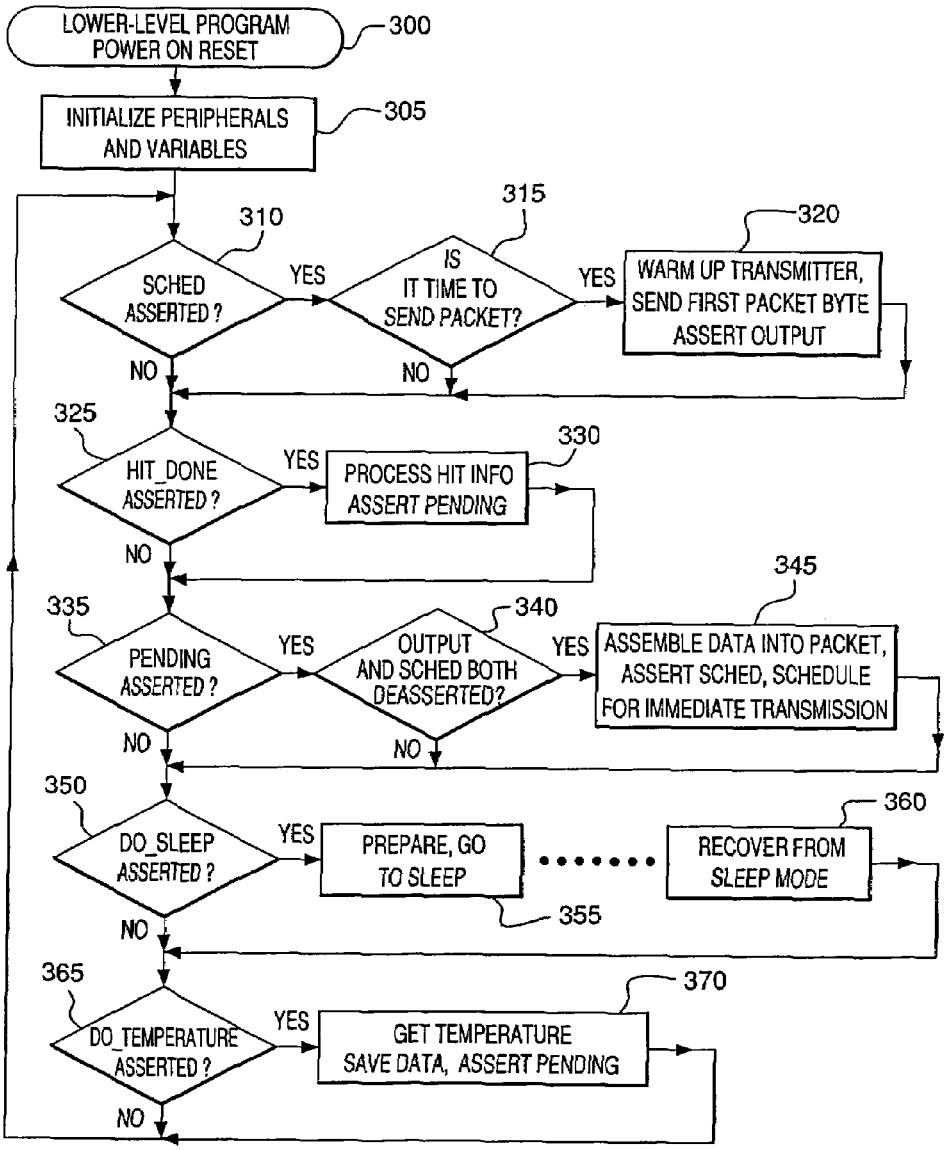
FIG. 7 is a flow chart illustrating a low level process flow in a sending unit according to the invention.

Referring now to FIGS. 6 and 7, an exemplary process flow will be explained. The process flow includes an interrupt routine, explained with reference to FIG. 6, which is run periodically. A lower level routine is explained with reference to FIG. 7. Software flags control flow between the two routines. Referring initially to FIG. 6, an interrupt service routine commences at 200. A sample value is obtained, the stored baseline is subtracted, and the force sensor is discharged, as indicated generally at 205. The next part of the process determines if the baseline requires updating. The baseline is updated periodically each N1 samples. If N1 samples have elapsed since the last baseline update, as indicated by block 210, then the baseline estimate is incremented in the direction of the baseline, as indicated by block 215. The use of an increment limits adjustment of the baseline to the value during a hit.

Whether or not the baseline is adjusted, the process flow proceeds to determine if the sample is above a selected threshold that represents a blow. The threshold has been previously selected based on suitable calibration. The selected threshold will vary depending on the application of the device of the invention. For example, if the device is to be used in training children in the martial arts, the threshold will be lower than if the device is to be used in professional heavyweight boxing matches.

As indicated by block 220, the process determines if the detected sample is above the threshold. If the sample is above the threshold, then the sample value is compared to a current hit maximum value, as indicated by block 225. The current hit maximum value is stored in an appropriate memory location. The current hit maximum value is the highest value recorded within a window. The window may be in the form of a minimum number of consecutive samples, such as four consecutive samples. The window may also be in the form of a selected duration. The window includes a sufficiently small number of consecutive samples not to encompass two or more separate blows, but large enough to encompass two or more peaks resulting from a single impact.

In one embodiment, if there is an appropriate flag, then the current hit maximum value is updated. Alternatively, if the sample value is above the current hit maximum value, then the current hit maximum value is updated, as indicated by block 230. The process flow then returns to the main process flow. If the sample is not above the current maximum, then the process flow returns to the main process flow.

If the sample is not above the threshold, the process moves to determining whether a hit is currently being processed, as indicated by block 235. The process flow looks for a flag set by the lower-level program to determine if a hit is currently being processed. Alternatively, the program may compare the baseline value and the current hit maximum register value, and determine that a hit is currently being processed if there is a value above the baseline in the current hit maximum register. If a hit is currently being processed, then the process determines if at least a minimum number of consecutive below-threshold samples have been received, and if at least a minimum number of consecutive above-threshold samples were received prior to the consecutive below-threshold samples, as indicated by block 240. If these standards for minimum numbers have been met, then a hit has been received. A software flag for a completed hit is asserted, as indicated by block 245. The completed hit data may include the maximum force of any sample and the number of samples constituting the hit or other duration information. The retained information may also include the impact value of each sample in the hit.

The process flow then checks to see if the selected time period of idleness before the processor goes into a sleep mode has passed since the last hit, as indicated by block 250. This time period may be 36 minutes, in the example. If the selected time period has elapsed, then a flag that will cause the device to be placed into sleep mode by the lower-level program is asserted, as indicated by block 255. The process flow then checks to see if sufficient time has elapsed since the last temperature reading to send a new temperature reading, as indicated in block 260. In the example, the selected time period is 36 seconds, but this time period may be varied. A flag is asserted if the time has elapsed, as indicated by block 265. The process flow then proceeds to determine if the serial output hardware is ready to accept another character. If the serial output hardware is ready, then a flag is checked to see if another character should be sent, as indicated by block 270. That character is received from a queue and output, as indicated by block 275. If the character was the last one in a packet, as indicated by block 280 then the next iteration of the same packet is scheduled, as indicated by block 285. A flag indicating that a packet is scheduled is asserted, and a flag indicating output is deasserted. If the byte just sent is not the last byte in the packet, the interrupt routine is complete.

Referring now to FIG. 7, the lower level routine will be explained. This routine is continuously running in the processor in the article of athletic equipment, except in sleep mode. The process flow commences when the device is powered on, as indicated at 300. The peripheral devices and variables are initialized, as indicated at 305. The process flow then looks to see if the SCHED flag has been asserted by the interrupt process flow, as indicated by block 310. If the SCHED flag has been asserted by the interrupt process flow, then the process flow proceeds to determine if it is time for the transmitter to send a data packet, as indicated by block 315. If it is time to send a packet, for example if sufficient data for a packet has been received, then the transmitter is instructed to send a packet, as indicated by block 320. The OUTPUT flag is asserted. As noted above, the output flag causes the interrupt routine to send a byte to the transmitter.

The process flow then determines if the HIT_DONE flag has been asserted, as indicated by block 325. As noted above, the HIT_DONE flag is asserted by the interrupt routine if sufficient consecutive below threshold samples have been detected following a sufficient number of above threshold samples. If this flag is asserted, the process flow proceeds to process the hit information for transmission, as indicated by block 330. The PENDING flag is asserted. If the PENDING flag is asserted, then the process flow proceeds to determine if the OUTPUT and SCHED flags are both deasserted, as indicated by blocks 335 and 340. If both flags are deasserted, then the transmitter may receive and transmit a packet. As indicated by block 345, the data is assembled into a packet. The SCHED flag is asserted and the packet is scheduled for immediate transmission. Data packets are described in more detail below.

The lower level program also checks for assertion of the DO_SLEEP flag, as indicated by block 350. As noted above, the DO_SLEEP flag is asserted by the interrupt routine if more than a threshold amount of time has elapsed since the most recent hit. If this flag is asserted, the processor is placed into a sleep mode. Recovery from sleep mode, as indicated by block 355, results from receipt of a signal from a detector, such as an inertial detector.

The lower level program also checks to see if the interrupt routine has asserted the DO_TEMPERATURE flag, as indicated by block 365. If the flag is asserted, the temperature data is obtained and the data is saved, and the pending flag is asserted.

Figure 8:
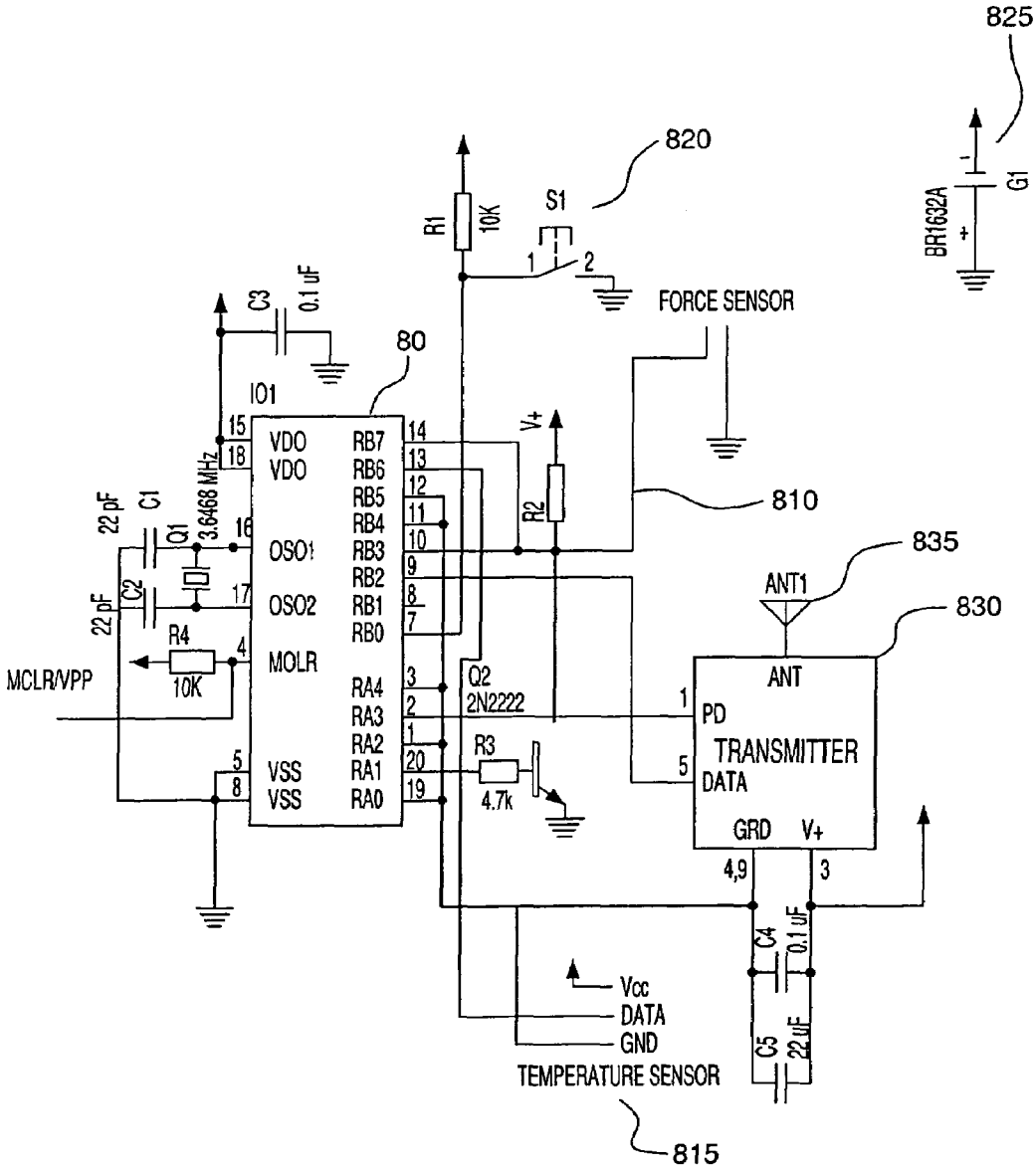
FIG. 8 is a circuit diagram of a sending unit in accordance with the invention.

Exemplary hardware for a sending unit associated with the sensor and mounted on board in the glove is shown in FIG. 8. A microcontroller 80 receives signals from force sensors via line 810, from a temperature sensor 815, which may be an electronic sensor, thermocouple, or other sensor, and inertial switch 820. Substitutions for the inertial switch may be made. A switch to be operated by a user may be provided, by way of example. Other types of detectors may be employed. Microcontroller 80 provides signals to transmitter 830. Battery 825 provides power for these devices. The transmitter may employ a single channel. Alternatively, a transmitter module that switches among multiple channels, or a transmitter that operates on the spread spectrum principle, may be used. For example, each packet may be sent one time on each of multiple channels. While various substitutions may be made, it is important to maintain the weight to a minimum in athletic equipment that is worn by the athlete. For example, the device described above has been found to have a total weight, including the sensor, wiring, processor, transmitter, battery and other electronics, of about one and one-half ounces. This weight has been found not to be noticeable to boxers testing gloves. In fact, the inventors have determined that weight variations can be common in boxing gloves.

The data transmitted includes an identification code unique to that one of the items of athletic equipment in use. For example, in the boxing implementation, gloves may be configured in sets of four, with each in the set having a different identification number. The data from each hit is preferably sent multiple times, such as three times, to reduce loss of data. The interval between transmissions may vary depending on which glove is employed. In one embodiment, a 00 is sent as a start-of-packet notification. A byte incorporating the glove identification number and a sequence number is transmitted. The sequence number is the same for each transmission of the same data, and is incremented for each packet containing new data. Three bytes of data are transmitted. A checksum may be provided.

Figure 9:
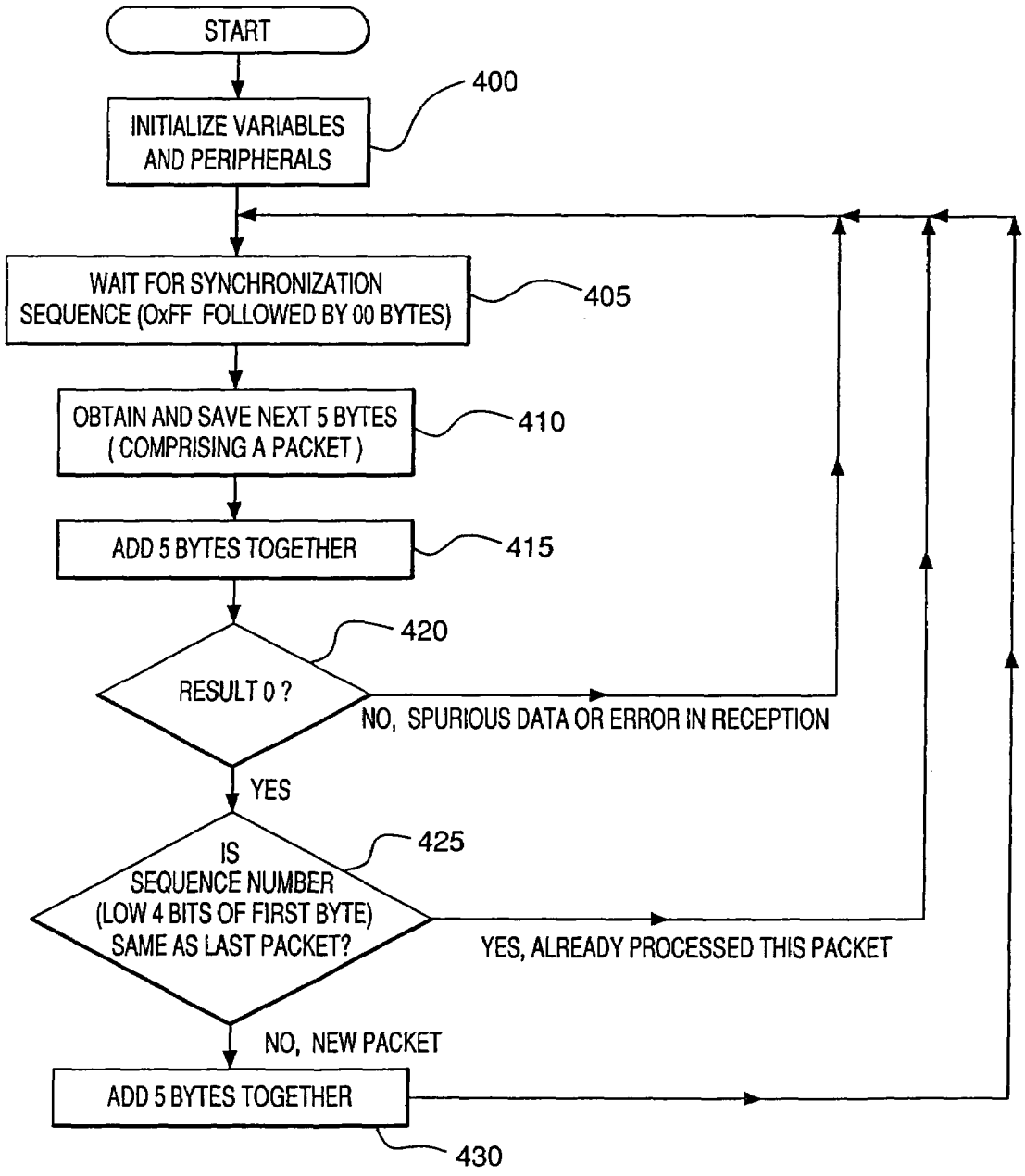
FIG. 9 is a flow chart illustrating a process flow in a receiving unit according to the invention.

Referring now to FIG. 9, the process flow of software for a receiver unit will be explained. The receiver software process flow may be implemented in a non-interrupt portion that initializes the receiver system, with all remaining processing conducted in interrupt routines. Referring to block 400, the process flow commences with initializing variables and peripherals when the receiver is activated. The process flow then awaits receipt of a synchronization sequence, as indicated by block 405. The synchronization sequence is distinct from a data packet, and may be in the form 0×FF. When a start-of-packet notification is received, then sufficient data to make up a packet, such as 5 bytes of data, are saved, as indicated by block 410. The received bytes are added together, as indicated by block 415. A checksum is performed, as indicated at decision block 420. If the checksum does not result in the appropriate value, the data is discarded, and the process flow returns to await the next packet. If the checksum is the appropriate value, the identification data is checked against the most-recent packet, as indicated by decision block 425. If the identification data is the same, then the packet is a repeat transmission, and the data is discarded, and the process flow returns to await the next packet. If the identification data is new, then the packet is forwarded to a processor, as indicated by block 430.

Figure 10:
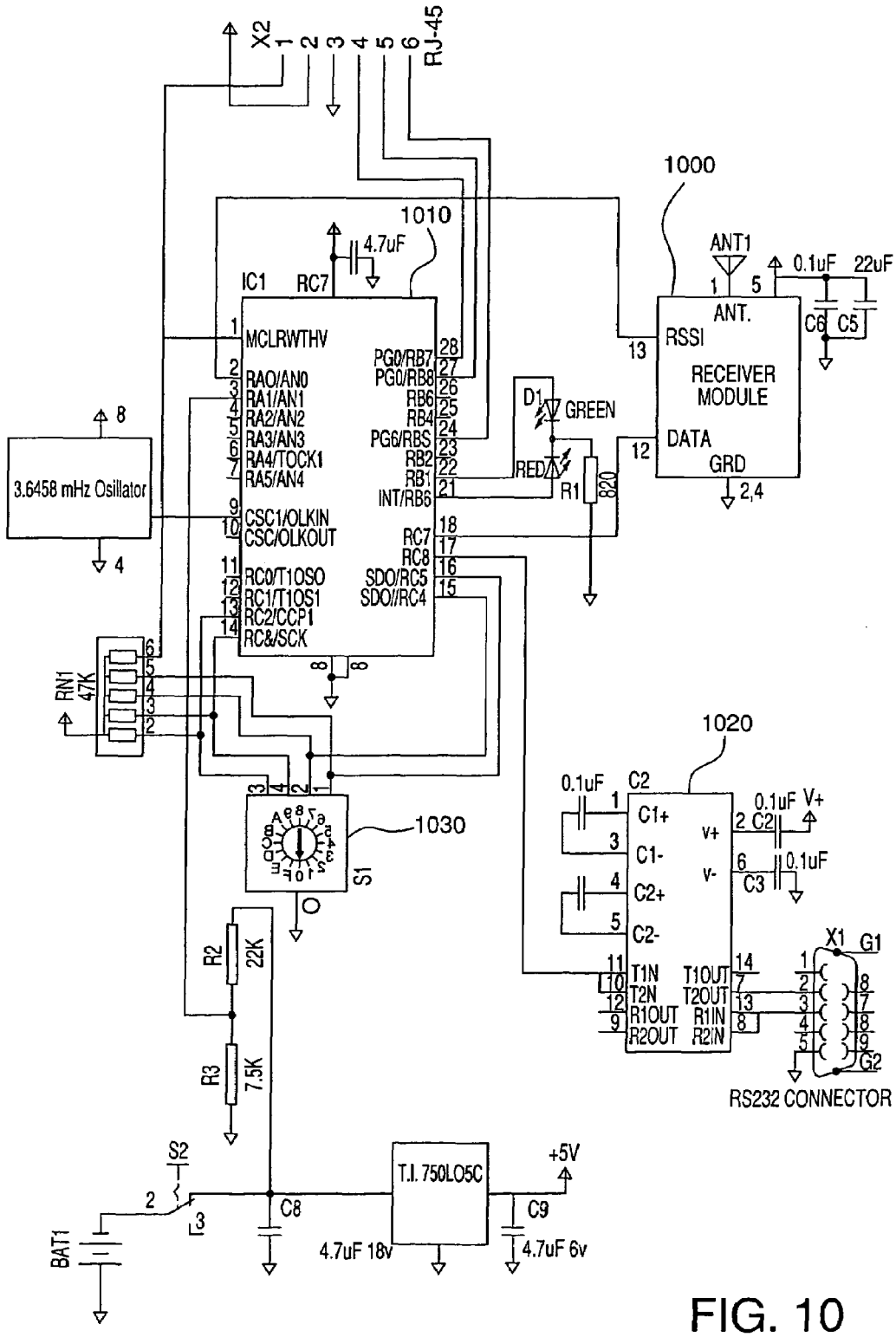
FIG. 10 is a circuit diagram of a receiving unit in accordance with the invention.

Exemplary receiver hardware is shown in FIG. 10. The hardware includes a receiver module 1000, a microcontroller 1010, and an RS-232 interface transceiver 1020, as well as a battery. A receiver may operate in a variety of modes, which may be accessed by switches, such as switch 1030.

While a transmitter and receiver has been described using radio frequency signals, suitable transmission technology, including ultrasound transmission, infrared, or other wireless electromagnetic or sonic transmission, may be employed. Redundant sensor driving circuitry, power supplies, and transmitters might be included to increase reliability.

The signal processing and display will now be described. A simple textual display is provided for glove ID, temperature data, maximum force and variables relevant to the impact duration. Referring now to FIG. 11, there is shown an exemplary text display. The display is in the form of a table in which each row is a packet of either temperature or detected hit data, and each column provides information regarding the hit or temperature. Glove identification column 505 is completed for each item. Sequence column 510 is completed for each hit. For each hit, maximum force column 515 has an unscaled value, as well as values at 518 for the samples before the maximum in the hit and values at 520 for the number of samples after the maximum in the hit. These numbers of samples serve as a display of the duration of the hit. For temperature packets, temperature column 525 is completed, with temperature shown in Fahrenheit.

Figure 12:
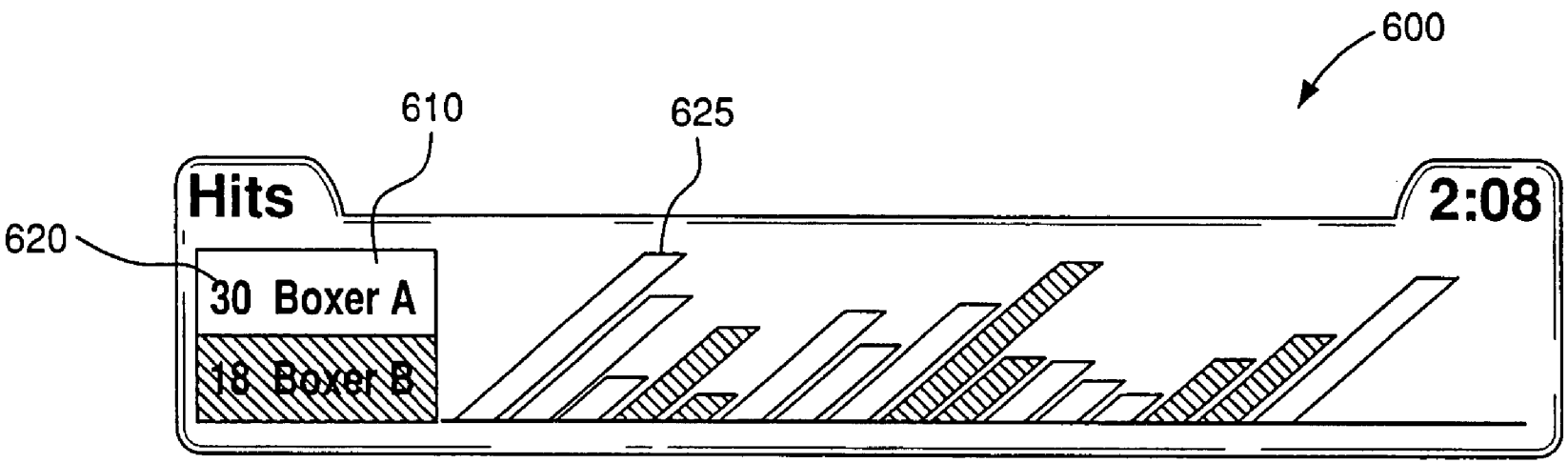
FIG. 12 is an example of a display in accordance with the invention.

A wide variety of other tabular and textual displays may be provided. Referring to FIG. 12, a display 600 featuring a graphical display of the detected force is shown. The graphical display includes the name of each boxer associated with a color. In this example, the boxer's name is on a field 610 of the selected color. The total detected hits scored in the round by that boxer are displayed adjacent the boxer's name at 620. The color coded graphical display indicates which boxer scored each hit. The detected force is displayed graphically. Each diagonal bar 625 represents a hit. Greater detected force is represented by greater length of the bar. In this representation, successive hits are equally spaced, and a selected number of the most recent hits are displayed. The display may be modified so that the horizontal axis represents time, so that the horizontal location of the bars represents the timing of the hits. Numerous other variations of the graphical display may be envisioned. For example, the numerical value may also be provided, either on or adjacent to the bar. The numerical value of the most recent detected hit may be displayed.

As described above, data in this or other formats may be provided to officials, broadcasters, reporters and others. Some boxing matches are monitored by officials who count every legal hit. The data may be synchronized with inputs by these officials, so that hits not noted by such officials, which are presumably not legal hits, are not displayed or counted.

It will be appreciated that a number of variations are possible within the scope of the invention. For example, the complete set of time and force values for the above-threshold samples in a hit may be transmitted. This data will permit such information as integration under the curve, to determine the total energy delivered by a blow. Transmitters may employ separate frequencies and have separate receivers to avoid interference. In principle, the elimination of samples below the threshold may be carried out in the receiver or the processor. However, the transmission of data for all samples would greatly decrease battery life.

The information generated by processor 80 may be provided to other types of devices for display or distribution. For example, impact information, including number of blows and force of blows, may be provided to a resource that makes the information available over a network. The resource may be a web server that is accessible over the Internet using the World Wide Web. The resource may have the information available during the match. The information may be made available from the resource in substantially real-time, or may be delayed by a selected period of time. The information may be distributed periodically during the match by e-mail, refreshing of web pages, text messages to cell phones, personal digital assistants, pages and other devices, or other suitable form of electronic transmission. The receipt of such transmissions may be purchased on a match-by-match basis, or offered as a package together with other services. Other information, including the round and time, whether the referee is starting a count, and the like, may also be made available through any of the foregoing methods.

The information may be made available only after the match. The information may be included in a database featuring information from the numerous matches after their completion. The information may also be included in data files that are distributed on media, such as on CD-ROM or magnetic disks, or may be available for distribution by electronic transmission over a network, or by electronic transmission over a telephone line from a bulletin board service. The information may be in a file in database format, in image format, in text format, or in any other suitable format. The information may be made available for later statistical analysis and study.

The running total of the number of blows may be employed in connection with scoring. The detection of a blow may be made visible to the judges on a suitably positioned device, for example. The judge may use the indication of a detected blow in deciding whether to award a point. As a detected blow is not necessarily a scoring blow, not every detected blow will be recorded as a point for the boxer. A signal representing the award of a point by a judge may be provided to a processor together with an automated detection of a blow. For example, suitable algorithms may be provided to award points only when the detection of a blow is followed within a certain interval by the award of a point by at least one or two of the judges. Other algorithms may be employed.

Boxing gloves of the invention have been tested against calibrated applications of force. In particular, two gloves of the invention were tested by mounting the gloves on a vertical test fixture and dropping an 8-pound padded platform from varying heights onto the gloves. Impact forces were measured by a load cell as up to 1400 pounds. It was found to be possible to calibrate the gloves, and the responses were repeatable, with a difference between the calculated force and the measured force approximately 4 percent. The same gloves were again tested after use in over 80 rounds of sparring. The average difference between the calculated force and the actual force was found to be less than 8 percent.

Testing of the sensors themselves was conducted by dropping a 12 pound weight from heights of three and six feet onto a sensor that had been subjected to 400 blows with a slightly padded baseball bat, and onto a new sensor. The results showed that the sensor subjected to the blows gave an output 9% to 13% less than the new sensor. These results indicate the durability of the sensor.

Boxing gloves of the invention have been used by boxers through hundreds of training rounds. The boxers have uniformly reported no change in the feel of the gloves.

The sensor of the invention has been found to measure forces up to 2000 pounds, while the electronics and sensors have maintained accuracy over hundreds of rounds. The sensor is light, flexible, shear-resistance, conformable, thin, and thus is invisible to the boxer or other participant in impact sports.

Force sensors and transmitters in accordance with the invention may be incorporated in other items of athletic equipment for use in training and in competition. Items of athletic equipment that receive blows or are worn by an athlete applying a blow have one or more sensors therein. The sensors may be capacitive force sensors as described above. The sensor may be positioned beneath a yielding surface of the item of athletic equipment. Examples of athletic equipment in which the sensor may be placed are heavy hitting bags, speed bags, training gloves, bag gloves, punching mitts, hitting targets and shields and body protection, including head gear, abdomen and foot protectors. Foot protectors, for example, are used in martial arts. In some martial arts, blows are delivered with a particular portion of the foot, such as the top surface of the foot. The sensor may be placed over the portion of the foot that is to deliver the blow, thereby confirming whether the blow was delivered with the proper portion of the foot. If a blow that appears to have significant impact provides only a relatively low recorded force, then the blow may have been delivered with an incorrect portion of the foot.

A circuit, of which the force sensor is a part, provides a signal indicative of impact detected, to a transmitter located in the item of equipment. The transmitter which transmits a signal indicative of the detected impact. A receiver is located in the same facility. In a training facility, such as a gymnasium, the receiver may be associated with electronics and a processor that include a display to provide real-time information received from the sensor visible to a trainer or coach, and/or to the athlete. The information may also be stored, such as in a format available to a database or spreadsheet program, for later review and analysis by the athlete, coaches and trainers. The use of sensors can provide the number of blows, the frequency, and the force. In the training context, it may be desirable to set a low threshold for detecting the force. The athlete, coach or trainer may find it desirable to see the impact of relatively light blows. A relatively light blow may also reflect that the blow is being delivered with the wrong part of the hand, or is poorly aimed. A computer may be provided with suitable software for storing and interpreting the data for use in coaching and training.

A force sensor may also be employed in competitions in the martial arts, with provision for display, communication and storage. Suitable programmed processing and displays may be provided to indicate such information as the number of blows and the force of the blows in real-time. As with boxing, the information may be accessible and transmitted remotely, and stored for later analysis.

A force sensor of the invention may also be embedded in padding of football uniforms to measure the force of hits in either practice or games.

It will be understood that the devices, methods and systems of the invention may be employed to measure characteristics other than force. For example, such information as energy and duration may be measured.

While the invention has been described with reference to specific embodiments, the invention is not limited to the described embodiments, and variations and modifications within the scope and spirit of the invention will be apparent to those of skill in the art.

What is claimed is:

1. A system for displaying data representing forces of impacts on articles of athletic equipment, comprising:

an article of athletic equipment, adapted to detect a characteristic of an impact and provide an output signal representative of the detected characteristic, having a body having an outer impact receiving surface portion, a force detector located within said body in communication with said impact receiving surface portion to detect force, a circuit coupled to said detector and adapted to provide an output signal representative of a force detected by said force detector, and a transmitter located in said body for receiving said output signal from said circuit and transmitting a wireless signal representative of said signal;

a receiver adapted to receive said wireless signal from said transmitter;

a processor coupled to said receiver, said processor obtaining force data from said wireless signal; and a display controller, said display controller providing an image signal of an event, said event having said article of athletic equipment therein, with said force data.

2. The system of claim 1, wherein the display controller is adapted to provide an image signal of said event having said force data superimposed on an image of said event.

3. The system of claim 2, wherein said article of athletic equipment is a boxing glove and said event is a boxing match during which said glove is worn by a boxer.

4. The system of claim 3, wherein said display controller comprises a video controller and said image signal comprises a video signal.

5. The system of claim 2, wherein said display controller comprises a video controller and said image signal comprises a video signal.

6. The system of claim 1, wherein said article of athletic equipment is a first boxing glove, said system further comprising second, third and fourth boxing gloves configured to provide second, third and fourth wireless signals representative of a force detected by associated second, third and fourth force detectors, said processor obtaining respective force data from said wireless signals, said display controller providing said image signal with force data associated with each of said wireless signals.

7. The system of claim 6, where said event is a boxing match between two boxers wearing said boxing gloves, wherein said display controller is adapted to provide an image signal of said event having force data superimposed on an image of said event.

8. The system of claim 7, wherein said wireless signals further comprise article of athletic equipment identifying data.

9. The system of claim 1, wherein said receiver is adapted to disregard corrupted signals and repeated signals.

10. The system of claim 1, wherein said circuit is interposed between an output of said force sensor and said transmitter, said circuit causing said transmitter to transmit said wireless signal only when said forces exceed a selected threshold.

11. The system of claim 1, wherein said force sensor is a capacitive force sensor, wherein said article of athletic equipment further comprises a temperature sensor having an output coupled to an input of said transmitter, and wherein said processor calibrates said force data based on temperature data from said temperature sensor.

12. An article of athletic equipment, adapted to detect a characteristic of an impact and provide an output signal representative of the detected characteristic, having a body having an outer impact receiving surface portion, a force detector located within said body in communication with said impact receiving surface portion to detect force, a circuit coupled to said detector and adapted to provide an output signal representative of a force detected by said force detector, and a transmitter located in said body for receiving said output signal from said circuit and transmitting a wireless signal representative of said signal, wherein said circuit is further adapted to:

sample force data from said detector;

store sampled force data in excess of a threshold;

compare said stored sampled force data with sampled data received within a time interval, selecting a higher of said stored and said received sampled data; and selectively transmit signals representing the highest sampled data received within said time interval.

13. The article of athletic equipment of claim 12, wherein said article is a boxing glove.

14. The article of athletic equipment of claim 12, wherein said sensor comprises a capacitive force sensor electrically coupled to said circuit.

15. The article of athletic equipment of claim 14, wherein said article of athletic equipment further comprises a temperature sensor having an output coupled to an input of said transmitter.

16. The article of athletic equipment of claim 14, wherein said circuit is adapted to transmit a difference between a detected force and a selected capacitive baseline.

17. The article of athletic equipment of claim 16, wherein said selected baseline is fixed.

18. The article of athletic equipment of claim 16, wherein said selected baseline is periodically updated.

19. An article of athletic equipment, adapted to detect a characteristic of an impact and provide an output signal representative of the detected characteristic, having a body having an outer impact receiving surface portion, a force detector located within said body in communication with said impact receiving surface portion to detect force, a circuit coupled to said detector and adapted to provide an output signal representative of a force detected by said force detector, and a transmitter located in said body for receiving said output signal from said circuit and transmitting a wireless signal representative of said signal, wherein said circuit is adapted to transmit sensor data only when a detected impact is above a selected threshold.

20. The article of athletic equipment of claim 19, wherein to find that an impact has been substantially completed, said circuit is further adapted to:

sample force data from said detector;

store sampled force data in excess of a threshold;

determine whether a specified number of successive below-threshold samples have been detected during a time interval; and selectively transmit signals representative of the highest sampled data received within said time interval.

* * * * *

UNITED STATES PATENT AND TRADEMARK OFFICE

CERTIFICATE OF CORRECTION

PATENT NO. : 7,384,380 B2
APPLICATION NO. : 11/180420
DATED : June 10, 2008
INVENTOR(S) : Kirk A. Reinbold et al.

It is certified that error appears in the above-identified patent and that said Letters Patent is hereby corrected as shown below:

On the Title Page, under section (*) Notice, add --This patent is subject to a terminal disclaimer.--

Signed and Sealed this

Thirtieth Day of September, 2008

JON W. DUDAS
*Director of the United States Patent and Trademark Office*